US010267567B1

(12) United States Patent
Ndao et al.

(10) Patent No.: US 10,267,567 B1
(45) Date of Patent: Apr. 23, 2019

(54) MONOLITHIC HEAT-TRANSFER DEVICE

(71) Applicant: NuTech Ventures, Inc., Lincoln, NE (US)

(72) Inventors: Sidy Ndao, Lincoln, NE (US); George Gogos, Lincoln, NE (US); Dennis Alexander, Lincoln, NE (US); Troy Anderson, Omaha, NE (US); Craig Zuhlke, Lincoln, NE (US)

(73) Assignee: NUtech Ventures, Lincoln, NE (US)

( * ) Notice: Subject to any disclaimer, the term of this patent is extended or adjusted under 35 U.S.C. 154(b) by 577 days.

(21) Appl. No.: 14/595,516

(22) Filed: Jan. 13, 2015

Related U.S. Application Data

(60) Provisional application No. 61/926,440, filed on Jan. 13, 2014.

(51) Int. Cl.
*F28D 15/00* (2006.01)
*F28F 13/00* (2006.01)
*F28D 15/02* (2006.01)

(52) U.S. Cl.
CPC ..... *F28D 15/02* (2013.01)

(58) Field of Classification Search
CPC .... F28D 15/02; F28D 15/0266; F28D 15/046; F28D 9/0093; F28F 3/086; F28F 21/085; F28F 21/06; F28F 21/02; H01L 23/3121
USPC ..... 165/104.26, 146, 256
See application file for complete search history.

(56) References Cited

U.S. PATENT DOCUMENTS 3,783,347 A * 1/1974 Vladik ..... H01L 23/3121 174/548
5,437,328 A * 8/1995 Simons ..... F28F 3/086 165/146
2005/0279491 A1* 12/2005 Thome ..... F28D 15/0266 165/272
2007/0298486 A1* 12/2007 Arora ..... B01J 19/0093 435/287.1

(Continued)

OTHER PUBLICATIONS

Agapov, R.L., Boreyko, J.B., Briggs, D.P. et al. (2014), "Length scale of Leidenfrost ratchet switches droplet directionality. Nanoscale" doi: 10.1039/c4nr02362e.

(Continued)

*Primary Examiner* — Davis D Hwu
(74) *Attorney, Agent, or Firm* — Leydig, Voit & Mayer, Ltd.

(57) ABSTRACT

A monolithic heat-transfer device can include a container wall configured to retain a working fluid, where the container wall is formed of a single material. The container wall also includes an interior surface configured to be in fluid communication with the working fluid. The monolithic heat-transfer device also includes a channel disposed in the interior surface of the container wall, where the channel comprises a microstructure and a nanostructure. The microstructure and the nanostructure are materially contiguous with the single material forming the container wall. In some embodiments, the nanostructure comprises one or more layers of nanoparticles. The monolithic heat-transfer device can be configured as a heat pipe, which can be constructed from the container wall and a second container wall joined together and sealed to one another to contain the working fluid (e.g., using laser welding, electron beam welding (EBW), and so forth).

17 Claims, 3 Drawing Sheets

(56) References Cited

U.S. PATENT DOCUMENTS

2010/0032150 A1* 2/2010 Determan ..... F28D 15/0266 165/246
2010/0132923 A1* 6/2010 Batty ..... F28D 15/046 165/104.26
2010/0294467 A1* 11/2010 Varanasi ..... F28D 15/046 165/108
2011/0186270 A1* 8/2011 Chou ..... F28F 21/02 165/104.28

OTHER PUBLICATIONS

Bradfield, W. (1966), "Liquid-solid contact in stable film boiling", Ind Eng Chem Fundam 5:200-204.
Brochard, F. (1989), "Motions of droplets on solid surfaces induced by chemical or thermal gradients", Langmuir 5:432-438.
Brzoska, J., Brochard-Wyart, F., Rondelez, F. (1993), "Motions of droplets on hydrophobic model surfaces induced by thermal gradients", Langmuir 9:2220-2224.
Chaudhury, M., Whitesides, G. (1992), "How to make water run uphill", Science (80-) 256:1539-1541. (Abstract).
Darhuber, A.A., Valentino, J.P., Davis, J.M. et al. (2003), "Microfluidic actuation by modulation of surface stresses", Appl Phys Lett 82:657. doi: 10.1063/1.1537512.
Dos Santos, F., Ondarcuhu, T. (1995), "Free-running droplets", Phys Rev Lett 75:2972. (Abstract).
Dupeux, G., Le Merrer, M., Lagubeaum G. et al. (2011), "Viscous mechanism for Leidenfrost propulsion on a ratchet", EPL Europhysics Lett 96:58001. doi: 10.1209/0295-5075/96/58001.
Grounds, A., Still, R., Takashina, K. (2012), "Enhanced droplet control by transition boiling", Sci Rep 2:720. doi: 10.1038/srep00720.
Hashmi, A., Xu, Y., Coder, B. et al. (2012), "Leidenfrost levitation: beyond droplets", Sci Rep 2:797. doi: 10.1038/srep00797.
Hwang, T.Y., Guo, C. (2011), "Polarization and angular effects of femtosecond laser-induced nanostructure-covered large scale waves on metals", J Appl Phys. doi: 10.1063/1.3646330.
John, K., Bär, M., Thiele, U. (2005), "Self-propelled running droplets on solid substrates driven by chemical reactions", Eur Phys J E Soft Matter 18:183-99. doi: 10.1140/epje/i2005-10039-1.
Kim, H., Truong, B., Buongiorno, J., Hu, L-W. (2011), "On the effect of surface roughness height, wettability, and nanoporosity on Leidenfrost phenomena", Appl Phys Lett 98:083121. doi: 10.1063/1.3560060.
Kruse, C., Anderson, T., Wilson, C. et al. (2013), "Extraordinary shifts of the Leidenfrost temperature from multiscale micro/nanostructured surfaces", Langmuir 29:9798-806. doi: 10.1021/1a401936w.
Lagubeau, G/, Le Merrer, M., Clanet, C, Quéré D (2011), "Leidenfrost on a ratchet", Nat Phys 7:395-398. doi: 10.1038/ nphys1925.
Linke, H., Alemán, B., Melling, L. et al. (2006), "Self-Propelled Leidenfrost Droplets", Phys Rev Lett 96:2-5. doi: 10.1103/PhysRevLett.96.154502.
Marin, A.G., Cerro, D.A. del (2012), "Capillary droplets on Leidenfrost micro-ratchets", Phys Fluids 24:122001.
Nayak, B.K., Gupta, M.C., Kolasinski, K.W. (2007), "Formation of nano-textured conical microstructures in titanium metal surface by femtosecond laser irradiation", Appl Phys A 90:399-402. doi: 10.1007/s00339-007-4349-2.
Ok, J.T., Lopez-Oña, E., Nikitopoulos, D.E., et al. (2010), "Propulsion of droplets on micro- and sub-micron ratchet surfaces in the Leidenfrost temperature regime", Microfluid Nanofluidics 10:1045-1054. doi: 10.1007/s10404-010-0733-x.
Piroird, K., Clanet, C., Quéré, D. (2012), "Magnetic control of Leidenfrost drops", Phys Rev E 85:10-13. doi: 10.1103/PhysRevE.85.056311.
Tsibidis, G.D., Stratakis, E., Loukakos, P.A., Fotakis, C. (2013), "Controlled ultrashort-pulse laser-induced ripple formation on semiconductors", Appl Phys A 114:57-68.
Vorobyev, A.Y., Guo C. (2013), "Direct femtosecond laser surface nano/microstructuring and its applications", Laser Photon Rev 7:385-407. doi: 10.1002/lpor.201200017.
Zuhlke, C.A., Anderson T.P., Alexander, D.R. (2013) "Comparison of the structural and chemical composition of two unique micro/nanostructures produced by femtosecond laser interactions on nickel", Appl Phys Lett 103:121603. doi: 10.1063/1.4821452.
Zuhlke, "Control and Understanding of the Formation of Micro/Nanostructured Metal Surfaces Using Femtosecond Laser Pulses," UMI No. 3546643.
Zuhlke et al., "Fundamentals of layered nanoparticle covered pyramidal structures formed on nickel during femtosecond laser surface interactions," Applied Surface Science 283 (2013), 648-653.
Zuhlke, C.A. et al. (2010), "Self assembled nanoparticle aggregates from line focused femtosecond laser ablation", Optics Express, vol. 18, No. 5, 4329-4339.
Zuhlke, C.A. et al. (2014), "A Fundamental Understanding of the Dependence of the Laser-Induced Breakdown Spectroscopy (LIBS) Signal Strength on the Complex Focusing Dynamics of Femtosecond Laser Pulses on Either Side of the Focus", Applied Spectroscopy, vol. 68. No. 9, 1021-1029.
Zhang, S., Gogos, G., "Film evaporation of a spherical droplet over a hot surface: fluid mechanics and heat! mass transfer analysis", J. Fluid Mech. 1991, 222, 543-563. (Abstract).
Biance, A, Clanet, C., Quere, D., "Leidenfrost drops", Phys. Fluids 2003, 15, 1632-1637.
Burton, J., Sharpe, A., van der Veen, R., Franco, A., Nagel, S., "Geometry of the vapor layer under a Leidenfrost drop", Phys. Rev. Lett. 2012, 109, 074301.
Vakarelski, I., Patankar, N., Marston, J., Chan, D., Thoroddsen, S., "Stabilization of Leidenfrost vapour layer by textured superhydrophobic surfaces", Nature 2012, 489 (7415), 274-277.
Vakarelski, I., Marston, J., Chan, D., Thoroddsen, S., "Drag reduction by Leidenfrost vapor layers", Phys. Rev. Lett. 2011, 106, 214501.
Carey, V. P., "Liquid-vapor phase-change phenomena", Taylor and Francis, 1992. (Abstract).
Bernardin, J., Mudawar, I., "The Leidenfrost point: experimental study and assessment of existing models", Transactions—American Society of Mechanical Engineers Journal of Heat Transfer 1999, 121, 894-903.
Tamura, Z., Tanasawa, Y., "Evaporation and combustion of a drop contacting with a hot surface", Symposium (International) on Combustion 1958, 7, 509-522.
Patel, B. M., Bell, K J., "The Leidenfrost phenomenon for extended liquid masses", Doctoral dissertation, Oklahoma State University, 1965. (Abstract).
Emmerson, G., "The effect of pressure and surface material on the leidenfrost point of discrete drops of water", Int. J. Heat Mass Transfer 1975, 18 (3), 381-386. (Abstract).
Xiong, T., Yuen, M., "Evaporation of a liquid droplet on a hot plate", Int. J. Heat Mass Transfer 1991, 34 (7), 1881-1894. (Abstract).
Hughes, F., "The evaporation of drops from super-heated nano-engineered surfaces", Doctoral dissertation, Massachusetts Institute of Technology, 2009.
Takata, Y., Hidaka, S., Yamashita, A., Yamamoto, H., "Evaporation of water drop on a plasma-irradiated hydrophilic surface", International Journal of Heat and Fluid Flow 2004, 25 (2), 320-328.
Munoz, R., Beving, D., Yan, Y., "Hydrophilic zeolite coatings for improved heat transfer", Ind. Eng. Chem. Res. 2005, 44, 4310-4315.
Huang, C., Carey, V., "The effects of dissolved salt on the Leidenfrost transition", Int. J. Heat Mass Transfer 2007, 50 (1), 269-282.
Arnaldo del Cerro, D., Marin, A., Romer, G., Pathiraj, B., Lohse, D., Huis in 't Veld, "Leidenfrost point reduction in micro-patterned metallic surfaces", Langmuir 2012, 28, 15106-15110.
Bizi-Bandoki, P., Benayoun, S., Valette, S., Beaugiraud, B., Audouard, E., "Modifications of roughness and wettability properties of metals induced by femtosecond laser treatment", Appl. Surf Sci. 2011, 257 (12), 5213-5218.
Wang, Z., Zheng, H., Xia, H., "Femtosecond laser-induced modification of surface wettability of PMMA for fluid separation in micro channels", Microfluid. Nanofluid. 2011, 10 (1), 225-229.

(56) References Cited

OTHER PUBLICATIONS

Wu,J., Xia,J., Lei, W., Wang, B., "A one-step method to fabricate lotus leaves-like ZnO film", Mater. Lett. 2011, 65 (3), 477-479.
Baldacchini, T., Carey, J., Zhou, M., Mazur, E., "Super-hydrophobic surfaces prepared by microstructuring of silicon using a femtosecond laser", Langmuir 2006, 22 (11), 4917-4919.
Koch, K., Bhushan, B., Jung, Y., Barthlott, W., "Fabrication of artificial Lotus leaves and significance of hierarchical structure for superhydrophobicity and low adhesion", Soft Matter 2009, 5 (7), 1386-1393. (Abstract).
Stratakis, E., Ranella, A., Fotakis, C., "Biomimetic micro/nanostructured functional surfaces for microfluidic and tissue engineering applications", Biomicrofluidics 2011, 5, 013411.
Feng, L., Zhang, Y., Xi, J., Zhu, Y., Wang, N., Xia, F., Jiang, L., "Petal effect: a superhydrophobic state with high adhesive force", Langmuir 2008, 24, 4114-4119.
Tull, B. Carey, J., Mazur, E., McDonald, J., Yalisove, S., "Silicon surface morphologies after femtosecond laser irradiation", MRS Bull. 2006, 31, 626-633.
Wu, B., Zhou, M., Li, J., Ye, X., Li, G., Cai, L., "Superhydrophobic surfaces fabricated by microstructuring of stainless steel using a femtosecond laser", Appl. Surf Sci. 2009, 256, 61-66. (Abstract).
Nayak, B., Gupta, M., Kolasinski, K., "Spontaneous formation of nanospiked microstructures in germanium by femtosecond laser irradiation", Nanotechnology 2007, 18, 195302.
Nayak, B., Gupta, M., "Ultrafast laser-induced self-organized conical micro/nano surface structures and their origin", Optics and Lasers in Engineering 2010, 48, 966-973.
Her, T., Finlay, R., Wu, C., Mazur, E., Femtosecond laser-induced formation of spikes on silicon. Appl. Phys. A: Mater. Sci. Process. 2000, 70, 383-385.
Yong Hwang, T., Guo, C., "Polarization and angular effects of femtosecond laser-induced conical microstructures on Ni", J. Appl. Phys. 2012, 111, 083518-083518.
Zuhlke, C., Anderson, T., Alexander, D., "Formation of multiscale surface structures on nickel via above surface growth and below surface growth mechanisms using femtosecond laser pulses", Opt. Express 2013, 21, 8460-8473.
Tsibidis, G., Barberoglou, M., Loukakos, P., Stratakis, E., Fotakis, C., "Dynamics of ripple formation on silicon surfaces by ultrashort laser pulses in subablation conditions", Phys. Rev. B 2012, 86, 115316.
Sanchez, F., Morenza, J., Trtik, V., "Characterization of the progressive growth of columns by excimer laser irradiation of silicon", Appl. Phys. Lett. 1999, 75, 3303-3305.
Crouch, C., Carey, J., Warrender, J., Aziz, M., Mazur, E., Genin, F., "Comparison of structure and properties of femtosecond and nanosecond laser-structured silicon", Appl. Phys. Lett. 2004, 84, 1850-1852.
Dolgaev, S., Lavrishev, S., Lyalin, A., Simakin, A., Voronov, V., Shafeev, G., "Formation of conical microstructures upon laser evaporation of solids", Appl. Phys. A: Mater. Sci. Process. 2001, 73, 177-181.
Pedraza, A., Fowlkes, J., Lowndes, D., "Self-organized silicon micro column arrays generated by pulsed laser irradiation", Phys. A: Mater. Sci. Process. 1999, 69, 731-734.
Wenzel, R., "Surface Roughness and Contact Angle" J. Phys. Chem. 1949, 53, 1466-1467.
Vorobyev, A., Guo, C., "Metal pumps liquid uphill", Appl. Phys. Lett. 2009, 94, 224102-224102.
Vorobyev, A., Guo, C., "Laser turns silicon superwicking", Opt. Express 2010, 18, 6455-6460.
Tran, T., Staat, H., Prosperetti, A., Sun, C., Lohse, D., "Drop impact on superheated surfaces", Phys. Rev. Lett. 2012, 108, 036101.
Avedisian, C., Koplik, J., "Leidenfrost boiling of methanol droplets on hot porous/ceramic surfaces", Int. J. Heat Mass Transfer 1987, 30, 379-393. (Abstract).
Quere, D., "Leidenfrost Dynamics", Annu. Rev. Fluid Mech. 2013, 45, 197-215.
Kietzig, A., Hatzikiriakos, S., Englezos, P., "Patterned superhydrophobic metallic surfaces", Langmuir 2009, 25,4821-4827.

* cited by examiner

MONOLITHIC HEAT-TRANSFER DEVICE

CROSS-REFERENCE TO RELATED APPLICATIONS

The present application claims the benefit under 35 U.S.C. § 119(e) of U.S. Provisional Application Ser. No. 61/926,440, filed Jan. 13, 2014, and titled "Monolithic Hierarchical Structures Micro Heat Pipe (MHSμHP)," which is herein incorporated by reference in its entirety.

FEDERALLY SPONSORED RESEARCH OR DEVELOPMENT

This invention was made with government support under Grant Number FA9451- 12-D-0195 awarded by the Air Force Research Laboratory. The government has certain rights in the invention.

BACKGROUND

The term "heat transfer" is used to describe thermal energy exchanged between physical systems. Thermal energy exchange can be described as heat dissipation that depends on temperature and pressure. Fundamental modes of heat transfer include conduction or diffusion, convection, and radiation. Heat transfer can also be described as an exchange of kinetic energy between particles through a boundary between two systems at different temperatures from one another, or from their surroundings. Thus, heat transfer occurs from a region of high temperature to another region of lower temperature, changing the internal energy of the systems involved.

SUMMARY

A monolithic heat-transfer device can include a container wall configured to retain a working fluid, where the container wall is formed of a single material. The container wall also includes an interior surface configured to be in fluid communication with the working fluid. The monolithic heat-transfer device also includes a channel disposed in the interior surface of the container wall, where the channel comprises a microstructure and a nanostructure. The microstructure and the nanostructure are materially contiguous with the single material forming the container wall. In some embodiments, the nanostructure comprises one or more layers of nanoparticles. The monolithic heat-transfer device can be configured as a heat pipe, which can be constructed from the container wall and a second container wall joined together and sealed to one another to contain the working fluid (e.g., using laser welding, electron beam welding (EBW), and so forth).

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Figure 1:
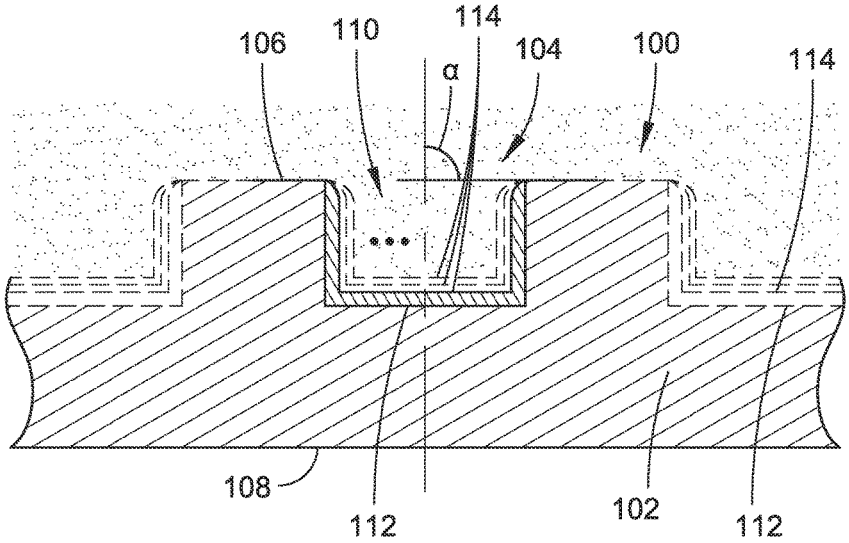
FIG. 1 is a partial cross-sectional side elevation view illustrating a heat-transfer device in accordance with example embodiments of the present disclosure.

Heat-transfer devices are described herein. In some embodiments, a heat-transfer device can be configured as a monolithic hierarchical structures micro heat pipe (MHSμHP). For example, a heat pipe comprises metallic microchannels having interior surfaces that include microstructures and nanostructures from the same base substrate metal. In this manner, the metallic microchannels, microstructures, and nanoparticles can be one piece (e.g., monolithic hierarchical structures) from the same base material. As described herein, heat-transfer devices with surfaces configured in accordance with the present disclosure can provide exceptional superwicking abilities, e.g., resulting from the presence of nanoparticles on top of microstructures. For instance, capillary flow of liquid material proximate to the surface of a heat-transfer device is enhanced by the presence of one or more nanoparticle layers, which can wick the liquid material deep into crevices in the surface of the heat-transfer device.

Referring generally to FIGS. 1 through 4, monolithic heat-transfer devices 100 are described. A heat-transfer device 100 comprises a substrate (e.g., a container wall 102) configured to contain a working fluid 104, where the container wall 102 is formed of a single material and includes an interior surface 106 and an exterior surface 108. The inner surface 106 is configured to be in fluid communication with the working fluid 104. The heat-transfer device 100 also includes one or more channels 110 disposed in the interior surface 106 of the container wall 102. In embodiments of the disclosure, each channel 110 can include one or more microstructures 112 and one or more nanostructures 114. As described herein, the microstructures 112 and the nanostructures 114 are materially contiguous with the material forming the container wall 102. Nanoparticles of the nanostructures 114 allow the working fluid 104 to wick deep into the microstructures 112 (e.g., into the interior surface 106 of the heat-transfer device 100). Further, the microstructures 112 can provide enhanced single-phase and/or two-phase heat transfer (e.g., facilitating change of phase of the working fluid 104). For example, in some embodiments, the microstructures 112 can provide an increase in the surface area of the interior surface 106 of the heat-transfer device 100 of about five (5) to seven (7) times (e.g., when compared to a heat-transfer device that does not use microstructures).

Figure 2:
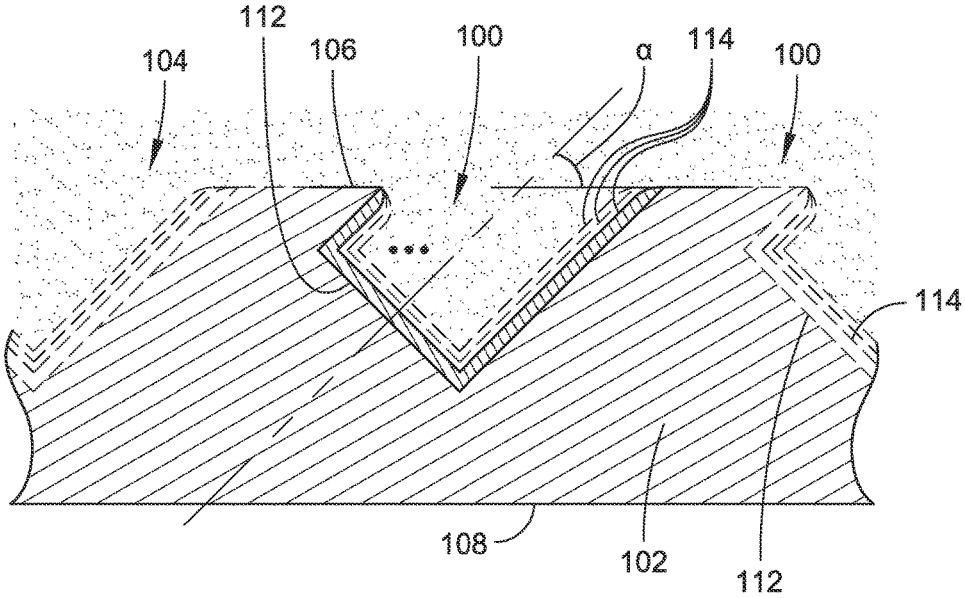
FIG. 2 is a partial cross-sectional side elevation view illustrating another heat-transfer device in accordance with example embodiments of the present disclosure.

In embodiments of the disclosure, the microstructures 112 can have various cross-sectional shapes, including, but not necessarily limited to: square, semi-circular, semi-elliptical, triangular, and so forth. Further, the microstructures 112 can be fabricated at various angles a, ranging from at least approximately normal to the interior surface 106 at zero degrees)(0°) (e.g., as shown in FIG. 1) to other angles from normal to the interior surface 106 (e.g., as shown in FIG. 2). In some embodiments, a can range up to at least approximately seventy degrees)(70°) from normal to the interior surface 106. However, it should be noted that an angle of seventy degrees)(70°) is provided by way of example and is not meant to limit the present disclosure. In other embodiments, a can be greater than seventy degrees)(70°) from normal to the interior surface 106.

In embodiments of the disclosure, the microstructures 112 can be fabricated with different aspect ratios and/or heights. As used herein, the term "aspect ratio" can refer to the ratio of, for example, the height (e.g., depth) of a microstructure 112 to the width of the microstructure 112. For example, the depth of a microstructure 112 can be equal to or less than at least approximately one hundred micrometers (100 μm). Further, the width of a microstructure 112 can range from about three-tenths of a micrometer (3/10 μm) to about one micrometer (1 μm) or more (e.g., depending on the spot size of a laser focused on the interior surface 106 to fabricate a microstructure 112). In some embodiments, a microstructure 112 can be several millimeters or more in width. In some embodiments, the thickness of a nanostructure 114 (e.g., the total thickness of one or more layers of nanoparticles) can be equal to or less than at least approximately ten micrometers (10 μm). However, these characteristic dimensions are provided by way of example and are not meant to limit the present disclosure. In other embodiments, the microstructures 112 can have different characteristic depths (e.g., greater than one hundred micrometers (100 μm)), the nanostructures 114 can have different characteristic thicknesses (e.g., greater than ten micrometers (10 μm)), and so forth.

In some embodiments, a laser process can be used to fabricate the microstructures 112 and the nanostructures 114 in the channels 110 in the substrate. For example, femtosecond laser surface processing (FLSP) laser pulses can be used to form a microstructure 112 with a nanostructure 114 (e.g., one or more layers of nanoparticles) sintered at the Gaussian edge of the laser pulse. Thus, in some embodiments, a nanostructure 114 can comprise metal oxides of a metallic base substrate material sintered by a laser pulse or laser pulses. For example, a nanostructure 114 comprising nickel oxide nanoparticles is generated when a microstructure 114 is formed in a nickel container wall 102. Other materials for constructing container walls 102 can include, but are not necessarily limited to: gold; steel alloys (e.g., stainless steel); titanium; aluminum; copper; zirconium alloys; silicon carbide; nickel-based, precipitation hardenable superalloys; silicon; germanium; various combinations of these materials; and so forth. In some embodiments, laser sintering can be used to control the thickness (e.g., layer density) of the nanostructures 114 (e.g., where a desired thickness is determined based upon, for example, wicking properties of the working fluid 104). However, it should be noted that laser sintering is provided by way of example and is not meant to limit the present disclosure. Thus, in other embodiments, the microstructures 112 and/or the nanostructures 114 can be formed using other processing techniques, including laser processes that do not involve sintering.

In implementations, the microstructures 112 and the nanostructures 114 in the channels 110 in the substrate can be formed using FLSP, which can develop the nanostructures 114 on the interior surface 106 through a combination of growth mechanisms, including, but not necessarily limited to: preferential ablation, capillary flow of laser-induced melt layers, and redeposition of ablated surface features. In implementations, the size and density of both micrometer and nanometer-scale surface features can be tailored by controlling FLSP conditions, such as laser fluence, incident pulse count, polarization, and incident angle, to thereby produce a multiscale metallic surface, which can affect heat transfer associated with, inter alia, change of phase of materials (see, e.g., Kruse et al., "Extraordinary Shifts of the Leidenfrost Temperature from Multiscale Micro/Nanostructured Surfaces," Langmuir, 29, 9798-9806 (2013); Zuhlke, "Control and Understanding of the Formation of Micro/Nanostructured Metal Surfaces Using Femtosecond Laser Pulses," UMI Number: 3546643; Zuhlke et al., "Comparison of the structural and chemical composition of two unique micro/nanostructures produced by femtosecond laser interactions on nickel," Appl. Phys. Lett. 103, 121603 (2013); Zuhlke et al., "Fundamentals of layered nanoparticle covered pyramidal structures formed on nickel during femtosecond laser surface interactions," Applied Surface Science 283 (2013), 648-653, which are incorporated herein by reference).

In some embodiments, a heat-transfer device 100 can be configured as a heat pipe 116, which can be used to manage heat transfer between two or more interfaces. For example, a heat pipe 116 includes one or more container walls 102 configured to retain working fluid 104, examples of which can include, but are not necessarily limited to: ammonia, alcohol (e.g., methanol, ethanol, etc.), water, refrigerants, liquid helium, mercury, cesium, potassium, sodium, indium, and so forth. The container wall 102 or container walls 102 can be sealed to contain the working fluid 104 (e.g., forming an envelope). In some embodiments, the working fluid 104 mass is chosen so that the heat pipe 116 can contain the working fluid 104 as both vapor and liquid (e.g., over the operating temperature range of the heat pipe 116).

In some embodiments, two halves 118 and 120 of metallic hypodermic tubes and/or milled slabs of metallic material (e.g., each comprising a container wall 102) are joined together, e.g., laser welded, electron beam welded (EBW), and so forth, to contain working fluid 104. In these embodiments, enhanced functionalized surfaces comprising microstructures 112 and nanostructures 114 can be fabricated on the interior surfaces 106 of the container walls 102 before adding the working fluid 104, and then the two halves 118 and 120 can be joined together and sealed to one another to contain the working fluid 104. Depending on the desired diameter, the interior surfaces 106 of the container walls 102 can be fabricated by laser processing (e.g., as previously described) and/or other processing. In this manner, the heat-transfer devices and techniques described herein can facilitate ease of assembly and/or a large range of microchannel dimensions.

The material of the container walls 102 can be selected based upon the working fluid 104. For example, a copper container wall 102 envelope can be used with water working fluid 104. In another example, a copper and/or steel container wall 102 envelope can be used with a refrigerant working fluid 104. In a further example, an aluminum container wall 102 envelope can be used with ammonia working fluid 104. In another example, a superalloy container wall 102 envelope can be used with an alkali metal working fluid 104 (e.g., cesium, potassium, sodium, and so forth). In this manner, the heat pipes 116 described herein can be used for various applications, including, but not necessarily limited to: electronics cooling applications; heating, ventilating, and air conditioning (HVAC) applications (e.g., for energy recovery); thermal control applications; temperature measurement device calibration applications; and so forth.

However, these container wall materials, working fluids 104, and applications are provided by way of example and are not meant to limit the present disclosure. Thus, in other embodiments, different materials for the container walls 102 and/or the working fluids 104 can be used, including, but not necessarily limited to: a stainless steel container wall 102 envelope with nitrogen, oxygen, neon, hydrogen, or helium working fluid 104; a copper container wall 102 envelope with methanol working fluid 104; an aluminum container wall 102 envelope with ethane working fluid 104; a refractory metal container wall 102 envelope with lithium working fluid 104; and so on. Further, heat pipes 116 as described herein can be configured as constant conductance heat pipes (CCHPs), vapor chambers (e.g., flat heat pipes), variable conductance heat pipes (VCHPs), diode heat pipes, loop heat pipes (e.g., micro loop heat pipes), and so forth.

Figure 3:
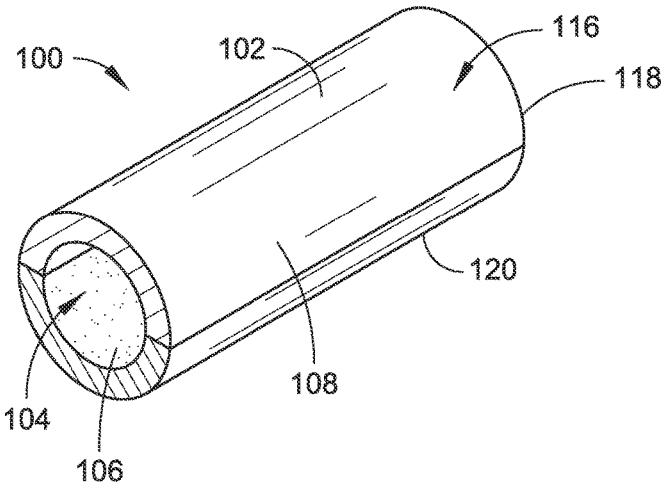
FIG. 3 is a partial cross-sectional isometric view of a heat-transfer device, such as the heat-transfer device shown in FIG. 1 or the heat-transfer device shown in FIG. 2, configured as a heat pipe in accordance with an example embodiment of the present disclosure.
Figure 4:
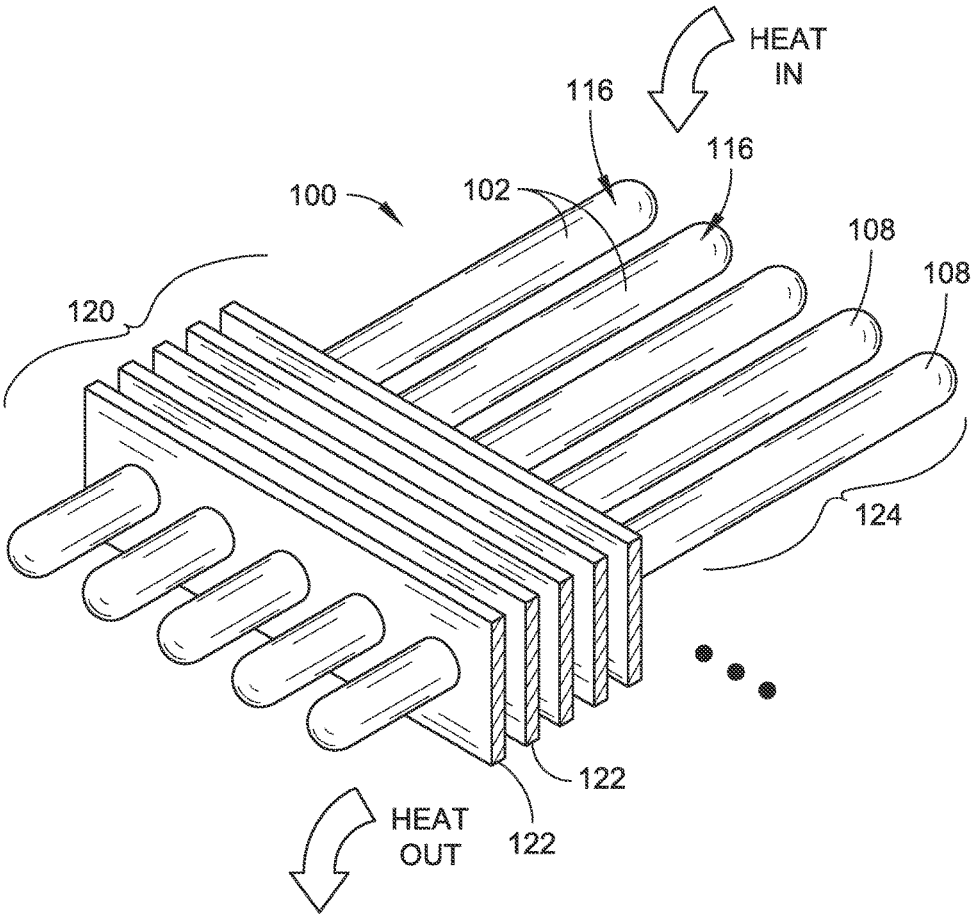
FIG. 4 is an isometric view of a heat-transfer device, such as the heat-transfer device shown in FIG. 1 or the heat-transfer device shown in FIG. 2, configured with multiple heat pipes in accordance with an example embodiment of the present disclosure.

In some embodiments, a heat-transfer device 100 can comprise a single heat pipe 116 (e.g., as shown in FIG. 3). In other embodiments, a heat-transfer device 100 can comprise multiple heat pipes 116, which can be mechanically and/or thermally connected together (e.g., without necessarily connecting the working fluids 104 in the various heat pipes 116). For example, as shown in FIG. 4, a heat-transfer device 100 includes an array of heat pipes 116 that form a condenser 120, where pipe ends can be connected together using, for instance, heat dissipation fins 122. The heat-transfer device 100 also includes an evaporator 124. As shown, heat flows from the evaporator 124 to the condenser 120 as the working fluid 104 moves from one end of the heat pipes 116 at the evaporator 124 to the other end of the heat pipes 116 at the condenser 120, and then back to the evaporator 124. However, it should be noted that the heat pipes 116 shown are provided by way of example and are not meant to limit the present disclosure. Thus, heat-transfer devices 100 can be configured for other various applications that use thermal management, including thermal management for microelectronics, nanoelectronics, laser diodes, energy conversion systems, and so forth.

Figure 5:
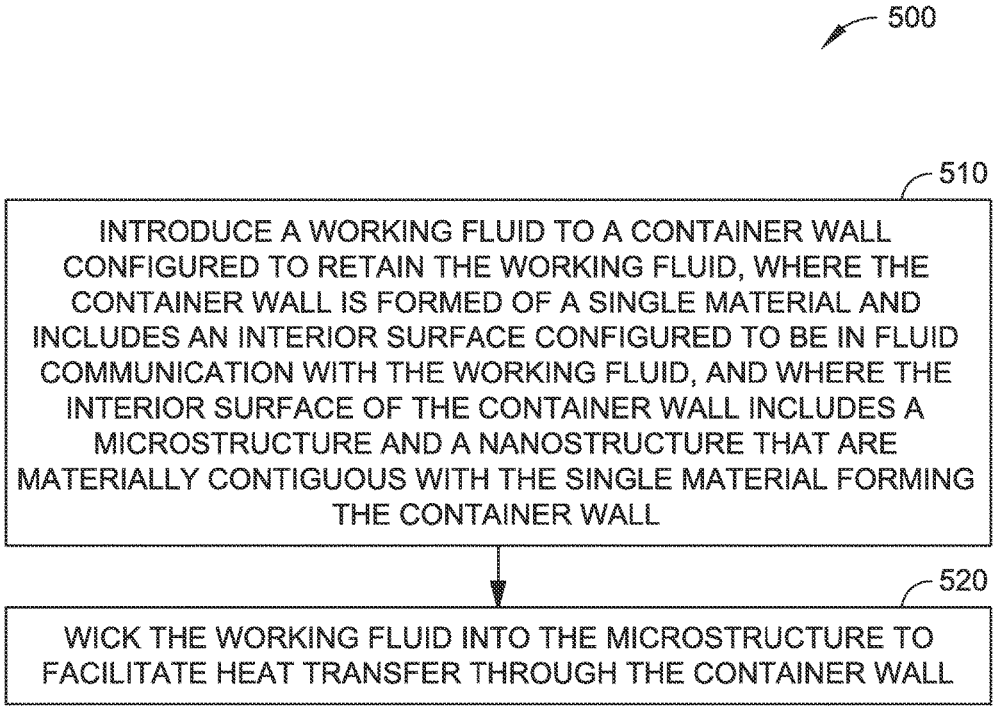
FIG. 5 is a flow diagram illustrating a method of facilitating heat transfer through a container wall in accordance with an example embodiment of the present disclosure.

The following discussion describes example techniques for facilitating heat transfer through a container wall. FIG. 5 depicts a procedure 500, in example embodiments, in which heat transfer is facilitated through a container wall by introducing a working fluid to the container wall, where the container wall includes one or more microstructures and one or more nanostructures formed on the interior surface of the container wall. In the procedure 500 illustrated, a working fluid is introduced to a container wall configured to retain the working fluid, where the container wall is formed of a single material and includes an interior surface configured to be in fluid communication with the working fluid, and where the interior surface of the container wall includes a microstructure and a nanostructure that are materially contiguous with the single material forming the container wall (Block 510). For example, with reference to FIGS. 1 and 2, working fluid 104 is introduced to container wall 102, which includes interior surface 106 with microstructures 112 and nanostructures 114 formed on the interior surface 106. Then, the working fluid is wicked into the microstructure to facilitate heat transfer through the container wall (Block 520). For instance, with reference to FIGS. 1 and 2, the working fluid 104 is wicked into the microstructure 112.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A monolithic heat-transfer device comprising a container wall configured to retain a working fluid;

wherein the container wall comprises an interior surface configured to be in fluid communication with the working fluid;

wherein at least one channel is disposed in the interior surface of the container wall, the channel including a functionalized surface comprising a plurality of microstructures and a plurality of nanostructures;

wherein the container wall is formed of a base material and the microstructures and the nanostructures are formed of a sintered oxide of the base material;

wherein the microstructures and the nanostructures are materially contiguous with the base material forming the container wall;

wherein the monolithic heat-transfer device comprises a heat pipe; and wherein the heat pipe is constructed from the container wall and a second container wall joined together and sealed to one another to contain the working fluid.

2. The monolithic heat-transfer device as recited in claim 1, wherein at least one nanostructure comprises at least one layer of nanoparticles.

3. The monolithic heat-transfer device as recited in claim 1, wherein the microstructures are less than at least approximately one hundred micrometers (100 μm) in depth.

4. The monolithic heat-transfer device as recited in claim 1, wherein the nanostructures are less than at least approximately ten micrometers (10 μm) in total thickness.

5. The monolithic heat-transfer device as recited in claim 1, wherein the container wall and the second container wall are joined together with at least one of laser welding or electron beam welding (EBW).

6. The monolithic heat-transfer device of claim 1, wherein the at least one channel protrudes into the interior surface of the container wall.

7. A monolithic heat pipe comprising a container wall configured to retain a working fluid;

wherein the container wall comprises an interior surface configured to be in fluid communication with the working fluid;

wherein at least one channel is disposed in the container wall interior surface, and formed at an angle from the interior surface, the channel including a functionalized surface comprising a plurality of microstructures and nanostructures;

wherein the container wall is formed of a base material and the microstructures and the nanostructures are formed of a sintered oxide of the base material;

wherein the microstructures and the nanostructures are materially contiguous with the base material forming the container wall; and wherein the heat pipe is constructed from the container wall and a second container wall joined together and sealed to one another to contain the working fluid.

8. The monolithic heat pipe as recited in claim 7, wherein at least one nanostructure comprises at least one layer of nanoparticles.

9. The monolithic heat pipe as recited in claim 7, wherein the microstructures are less than at least approximately one hundred micrometers (100 μm) in depth.

10. The monolithic heat pipe as recited in claim 7, wherein the nanostructures are less than at least approximately ten micrometers (10 μm) in total thickness.

11. The monolithic heat pipe as recited in claim 7, wherein the container wall and the second container wall are joined together with at least one of laser welding or electron beam welding (EBW).

12. The monolithic heat pipe of claim 7, wherein the at least one channel protrudes into the interior surface of the container wall.

13. A monolithic heat-transfer structure configured to retain a working fluid, wherein the monolithic structure comprises:

an interior surface configured to be in fluid communication with the working fluid; and one or more channels disposed in, and protruding into, the interior surface of the monolithic structure, the one or more channels each including a functionalized surface comprising a plurality of microstructures and a plurality of nanostructures;

wherein the monolithic structure comprises a base material and the plurality of microstructures and the plurality of nanostructures comprise a sintered oxide of the base material; and wherein the plurality of microstructures and the plurality of nanostructures are materially contiguous with the base material of the monolithic structure.

14. The monolithic heat-transfer structure of claim 13, wherein at least one of the one or more channels protrudes into the interior surface angled relative to a normal to the interior surface.

15. The monolithic heat-transfer structure of claim 13, wherein at least one nanostructure of the plurality of nanostructures in at least one channel comprises at least one layer of nanoparticles.

16. The monolithic heat-transfer structure of claim 13, wherein the plurality of microstructures in each of the one or more channels are each less than at least approximately one hundred micrometers (100 μm) in depth.

17. The monolithic heat-transfer structure of claim 13, wherein the plurality of nanostructures in each of the one or more channels are each less than at least approximately ten micrometers (10 μm) in total thickness.

* * * * *